United States Patent [19]

Halevy

[11] Patent Number: 4,813,137

[45] Date of Patent: Mar. 21, 1989

[54] RAZOR BLADE UNIT

[76] Inventor: Ben-Zion Halevy, 5 Alonim St., Nazaret Ilit, Israel

[21] Appl. No.: 52,158

[22] Filed: May 18, 1987

Related U.S. Application Data

[63] Continuation of Ser. No. 829,086, Feb. 13, 1986, abandoned.

[30] Foreign Application Priority Data

Mar. 1, 1985 [IL] Israel ..... 74478

[51] Int. Cl.[4] ..... B26B 21/00

[52] U.S. Cl. ..... 30/50; 30/75

[58] Field of Search ..... 30/50, 51, 75, 32, 47

[56] References Cited

U.S. PATENT DOCUMENTS 3,259,978 7/1966 Wrichsolbaum ..... 30/32
3,724,070 4/1973 Dorion ..... 30/50 X
3,832,774 9/1974 Perry ..... 30/50 X
4,475,286 10/1984 Saito ..... 30/51 X

*Primary Examiner*—Douglas D. Watts
*Attorney, Agent, or Firm*—Fleit, Jacobson, Cohn & Price

[57] ABSTRACT

There are provided razor blades of the type where one or two blades are provided in a housing of molded plastic which defines the shaving geometry. In the blade system of the invention the lower base member of the unit has a guard member in front of the cutting edge of the forward blade and another member behind the blade or blades, which members together define the shaving system plane, the geometry of the shaving system including the accurate position of the blade or blades being determined by said lower member, the upper cap member which is attached to the base member, serving only to complement the lower unit and to press on the blade or blades, and for attachment to a suitable razor handle.

9 Claims, 1 Drawing Sheet

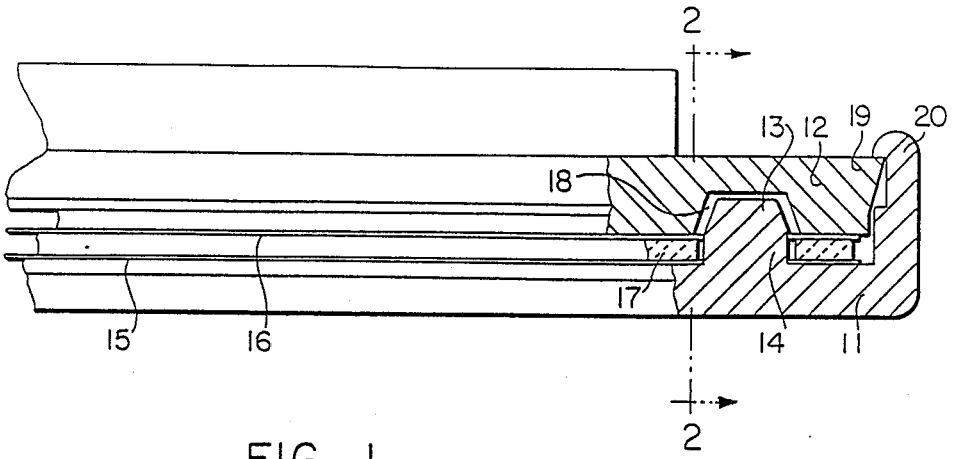
FIG. 1
FIG. 2
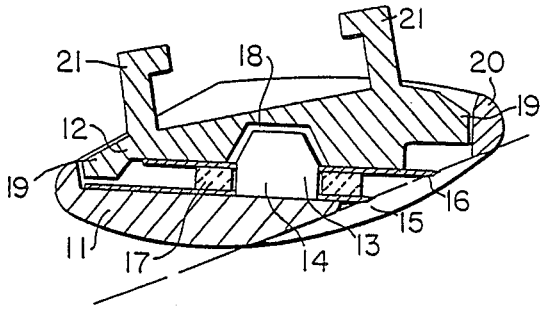
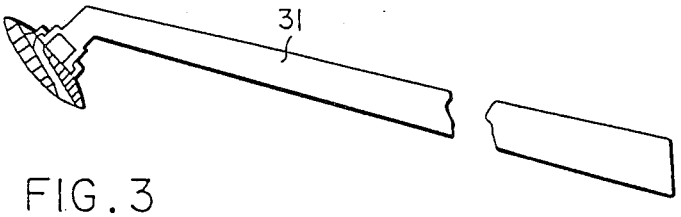
FIG. 3

RAZOR BLADE UNIT

This application is a continuation of application Ser. No. 829,086, filed Feb, 13, 1986, now abandoned.

FIELD OF THE INVENTION

The present invention relates to improved blade units for shaving systems. More particularly, the invention relates to razor blade units wherein the blade or blades is or are permenently secured in a housing, in a predetermined position respective a guard element.

BACKGROUND OF THE INVENTION

There are widely used razor blade units wherein one or two elongated razor blades, each with one cutting edge, are permanently secured in a housing made of molded plastic. Such blades are either provided with an integral handle (disposable units), or they are adapted to be attached to a handle by suitable coupling means. Such conventional blade units comprise a base member and a cap member, between which there are positioned one or two blades. When two blades are used, these are in a staggered position, with a spacer between them, with the cutting edges being offset, with a guard member in front of the cutting edge of the first blade, and another member behind the cutting edge of the second blade, both of which define the geometry of the shaving system, the plane defined by these and the position of the cutting edges respective this surface determining the shaving characteristics of the unit. This type of blades, with one or two blades, is very well known and such blades constitute a large percentage of the market of razor blades.

With conventional twin-blade razor blade units, the geometry of the blades and that of the two members of the housing, namely the guide in front of the blades (guard structure) and the member to the rear of the edges of the blades, defines a plane which determines the shaving characteristics.

The relation of the cutting edges of the blades vis-a-vis this plane is quite critical. According to the prior art, the exposure of the cutting edges is advantageously between −0.002 to +0,004 inch. The problem with prior art structures is in that the geometry is determined by the interaction of two parts made of molded plastic, which are machined to a high degree of accuracy, but which are secured with each other by a number of rivets (cold riveting), which rivets also serve as supports for the blades and spacer. The conventional blades are attached to a suitable handle by a rigid grip structure or by a swivel connection.

The critical blade edge parameters depend on the accuracy of the riveting of the two components of the housing, and this brings about certain variations from blade to blade unit.

Such conventional blade units comprise a base and a cap member, usually injection molded, intermediate of which are positioned one or two blades which are positioned on pins extending from the base member. When such a blade unit is assembled at the manufacturing plant, the blades with the interposition of a spacer between two blades are set on said pins which pass through holes in the blades and spacer, whereupon the cap member is also set on the pins, these latter are deformed at their outermost ends to constitute rivet heads, so fixedly uniting all parts and holding them together. As is well known, the blade or blades have to be accurately positioned in the unit relative to one another, with a minimum of tolerances being allowable. However, attaching the two members (cap and base) with one another and causing the above mentioned heading of the pins has also the consequence of displacing the individual blades and disturbing the relative position between them, as well as their position relative in the holding members.

SUMMARY OF THE INVENTION

According to the invention, there is provided a razor blade unit comprising one or two blades which are held between a base member and a cap member, on short pins extending from the said base member, with the interposition of a spacer in the two blade structures, which base member also defines the guard member in front of the blades and a rear surface, there being provided fixing means of the cap and base members such as two teeth, one each extending from opposite edges of the base member and engaging the said cap member at opposite edges thereof. Other means of securing the cap and base member can be used.

The present invention overcomes all these drawbacks by providing one unit of molded plastic "of the base member", which is manufactured with a high degree of accuracy, and which unit determines all the critical parameters of the shaving system: it comprises two or more cylindrical pins which engage suitably dimensioned holes of the blades and spacer, thus fixing them in an accurate manner in position and this unit is provided with a guard structure in front of the off-set cutting edges, and with a rear member, which together define the plane which comes into contact with the skin during shaving, and according to which the position of the cutting edges is measured. The provision of all of these in one single unit is a considerable improvement: the other member ("cap member") serves only to secure the components together in a tight fit, and for the attachment of a handle, of the type used with conventional bonded blades, or of any other desired structure. The handle can also be molded in an integral manner with the said cap member. Said second member (cap member) is provided with suitable recesses for accommodating the upper ends of the said pins (which may be of conical shape at their upper end), and with connecting means to the lower base member. The connection can be via suitable mechanical elements, but not by said pins; it may be by means of teeth engaging the edge of the second member, as will be illustrated in the following.

As pointed out, the main feature and innovation is in the provision of a base member defining the shaving surface and which also determines the position of the blades and spacer.

Although the invention relates to both single and multiple-blade razor blade shaving units, the invention is illustrated by way of example with reference to double-blade units.

DESCRIPTION OF THE PREFERRED EMBODIMENT

The invention is illustrated with reference to the enclosed schematical drawings, which are not according to scale, and in which:

FIG. 1 is a fractional side-view, partly in section of a twin-blade unit;

FIG. 2 is a section on line II—II of FIG. 1.

FIG. 3 illustrates a unit attached to a razor handle.

The novel blade unit comprises: a base member 11, and a cap member 12. From base member 11, extend two short pins 13, the upper ends of which are frustoconical while the portion 14, adjacent the plane of base 11, is cylindrical. This shape facilitates the exact positioning of the blades and spacer on the pins. The said pins are advantageously positioned near the opposite, outer edges of base 11. Onto the said pins 13, are set blades 15 and 16, with the interposition of a spacer 17. The pins 13 enter correspondingly shaped frustoconical recesses 18 in the cap member 12, with some space remaining between these two. There can also be provided suitable elongated recesses.

From opposite edges of base member 12, extend teeth 19, which engage opposite recesses 20 of the base member 11. As can be seen in FIG. 1, the said outer edge of the cap 12, is skived thus presenting an outermost sharp edge to be engaged by the tooth 19, The cap member engages the blade-spacer-blade assembly, holding it tightly in place. Both base and cap members are injection-molded plastics, thus in assembling the blade unit the teeth 19, can be made to engage the edge 20, by snap action, the connection between parts 11 and 12, so being—at least as far as the ultimate user of the blade unit is concerned—irreversible. The pins and corresponding holes are produced with a high accuracy and thus the geometry of the shaving system is formed in a highly accurate menner. It will be seen that in the manner described heading of the pins 13, is no longer necessary, the pins serving the sole purpose of highly accurate orientation of the blades, without danger of displacement of these. Of course, there is also an incidental advantage of some economy in the manufacturing or assembling process by eliminating the step of heading the pins.

The razor blade illustrated is provided with a rail member 21, which is adapted to engage a conventional razor handle of the type used all over the world.

FIG. 3, illustrates the attachment of a blade unit to a razor handle 31.

The razor blade units can be provided with means of attachment to other types of handle, swivel-type or others, and such attachment means are not part of the invention.

From the above it will be clear that the entire geometry of the shaving system, which requires a very high degree of accuracy, is provided by one single member which is the base member 11, This base member supports the blade or blades, it defines the front edge of the shaving unit which is critical as regards the shaving action and also the rear support of the blade or blades.

The fact that this one and single member 11, defines all the critical parameters of the shaving system is of considerable advantage. Hitherto the parameters were a combination of those of the base member and of the cap member, and this of course depended on the exact coordination of these parts, with possibilities of certain degrees of inaccuracy during assembly, machining and alignment. All these possible inaccuracies are obviated and when the base part 11, is machined accurately, this guarantees an accurate and satisfactory final product.

I claim:

1. A razor blade unit comprising a base member having a front guard member and a rear member which together define a surface of a shaving system, said base member including two pins having a cylindrical base, blade means including holes corresponding to said pins, said blade means being positioned on said pins to accurately position said blade means, an upper cap member, fixing means defined by said upper cap member and said base member for securing said upper cap member to said base member and to press a part of said upper cap member on said blade means and to hold said blade means in place, said fixing means including two teeth, one extending from each end of opposite edges of said base member, said two teeth engaging said cap member at opposite edges of said cap member, and attachment means for attaching a handle to said cap member.

2. A razor blade unit as claimed in claim 1, wherein outer edges of said cap member include a sharp outer edge portion, to be engaged by said teeth.

3. A razor blade unit as claimed in claim 1, wherein said blade means includes a razor blade.

4. A razor blade unit as claimed in claim 1, wherein said blade means includes two razor blades with a spacer located therebetween.

5. A razor blade unit comprising:

a base member having a front guard member and a rear member which together define a surface of a shaving system, said base member including two pins having a cylindrical base, blade means including holes corresponding to said pins, said blade means being positioned on said pins to accurately position said blade means, an upper cap member, said pins being cylindrical at a base which engages said blade means, and conical at a top, said upper cap member including a recess for each of said pins, fixing means defined by said upper cap member and said base member for securing said upper cap member to said base member and to press a part of said upper cap member on said blade means and to hold said blade means in place, said fixing means including two teeth, one extending from each end of opposite edges of said base member, said two teeth engaging said cap member at opposite edges of said cap member to snap-lock said base member and said cap member together, and attachment means for attaching a handle to said cap member.

6. A razor blade unit comprising:

a base member having a central recess and including both a front edge guard member and a rear support member, two pins extending from said base member, blade means having only one cutting edge and including holes corresponding in dimension and spacing to said two pins, said blade means being positioned on said two pins to align said cutting edge in a predetermined location with respect to said front edge guard member and said rear support member, a cutting plane for said razor blade unit being defined by said front edge guard member, said cutting edge and said rear support member, a cap member located in said central recess with said blade means, at least one recess portion defined by said cap member for housing a terminal portion of said two pins, and fixing means defined at least in part by each of said base member and said cap member for permanently securing said cap member to said base member while firmly pressing said cap member against said blade means and housing said terminal portion of said two pins in said at least one recess portion without deformation of said two pins, said fixing means including two teeth, one extending from each end of opposite edges of said base member, said two teeth engaging said cap member at opposite edges of said cap member to snap-lock said base member and said cap member together.

7. A razor blade unit as claimed in claim 5, wherein said blade means includes a razor blade.

8. A razor blade unit as claimed in claim 5, wherein said blade means includes two razor blades with a spacer located therebetween.

9. A razor blade unit according to claim 5, wherein said pins are located adjacent to edges of the razor unit.

* * * * *